United States Patent [19]

Wilson

[11] 3,945,915

[45] Mar. 23, 1976

[54] METHOD OF AND APPARATUS FOR ASSORTING PARTICLES ACCORDING TO THE PHYSICAL CHARACTERISTICS THEREOF

[75] Inventor: Donald C. Wilson, San Jose, Calif.

[73] Assignee: FMC Corporation, San Jose, Calif.

[22] Filed: Dec. 30, 1974

[21] Appl. No.: 537,485

Related U.S. Application Data

[62] Division of Ser. No. 330,896, Feb. 9, 1973, Pat. No. 3,904,517.

[52] U.S. Cl. ..... 209/12; 209/115; 209/480

[51] Int. Cl.[2] ..... B07B 15/00

[58] Field of Search ..... 209/12, 13, 19, 20, 112, 209/115, 118, 134–137, 145, 149, 32–35, 479, 480

[56] References Cited

UNITED STATES PATENTS

| | | | |
|---|---|---|---|
| 753,591 | 3/1904 | Langerfeld | 209/118 |
| 2,281,174 | 4/1942 | Steele | 209/112 |
| 2,717,692 | 9/1955 | Brown et al. | 209/19 |
| 2,778,498 | 1/1957 | Vincent | 209/118 |
| 2,828,011 | 3/1958 | Whitby | 209/20 |
| 2,875,895 | 3/1959 | Traylor | 209/112 |
| 3,044,619 | 7/1962 | Knolle | 209/33 |
| 3,473,657 | 10/1969 | Graf et al. | 209/117 |

FOREIGN PATENTS OR APPLICATIONS

| | | | |
|---|---|---|---|
| 623,320 | 12/1935 | Germany | 209/20 |
| 1,166,596 | 3/1964 | Germany | 209/134 |

*Primary Examiner*—Frank W. Lutter
*Assistant Examiner*—Ralph J. Hill
*Attorney, Agent, or Firm*—R. S. Kelly; C. E. Tripp

[57] ABSTRACT

Particles flowing in a stream can be arranged in an order of classification extending transversely of the stream according to physical characteristics of the particles by self-screening and stratification which occur in response to a continuous vibratory feeding of the particles in a direction laterally of the direction of flow of the stream. Particles having similar physical characteristics will flow from a specific portion of the stream into a collecting receptacle having a plurality of compartments arranged in a line transversely of the stream for separately collecting as many stream portions as required to obtain the desired degrees of separation. Further particle assortment from each stream portion can be made in accordance with the particles trajectory of fall from the stream bed.

3 Claims, 24 Drawing Figures

FIG_6
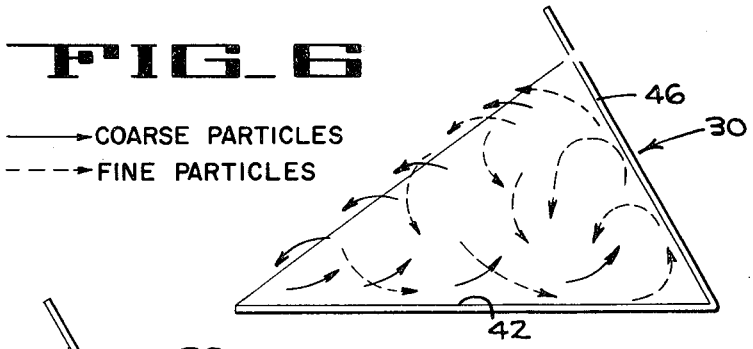
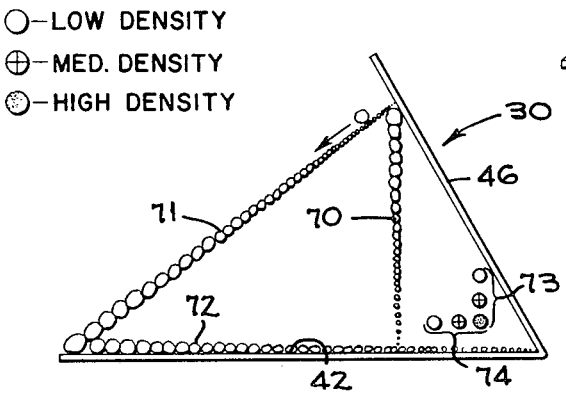
FIG_5
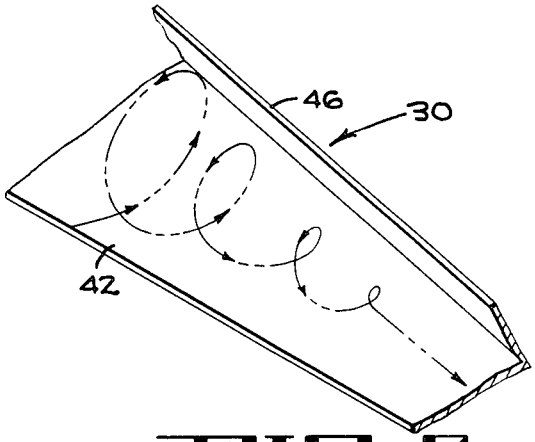
FIG_7
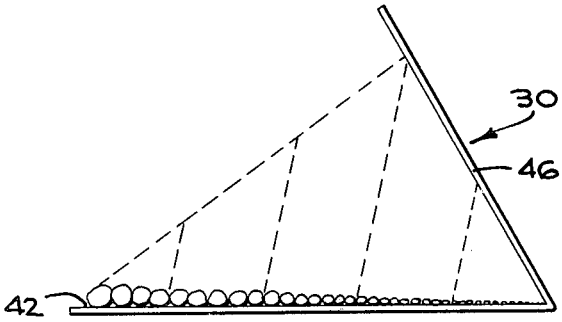
FIG_8
FIG_9
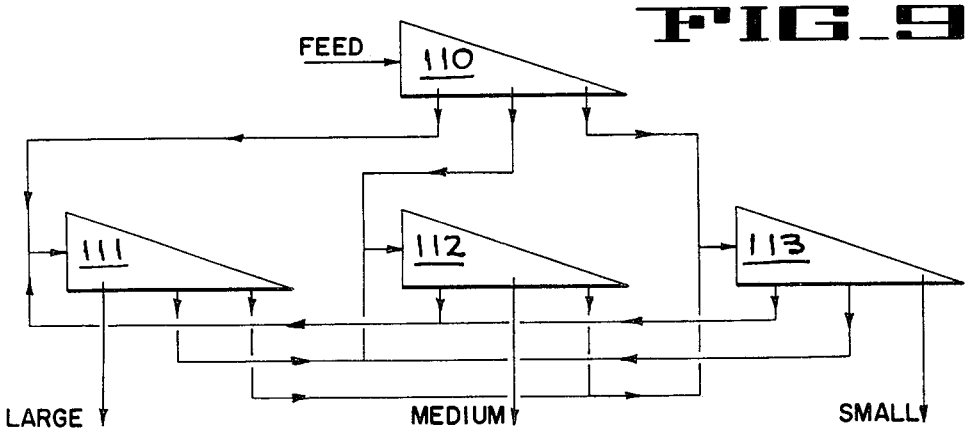

FIG_14
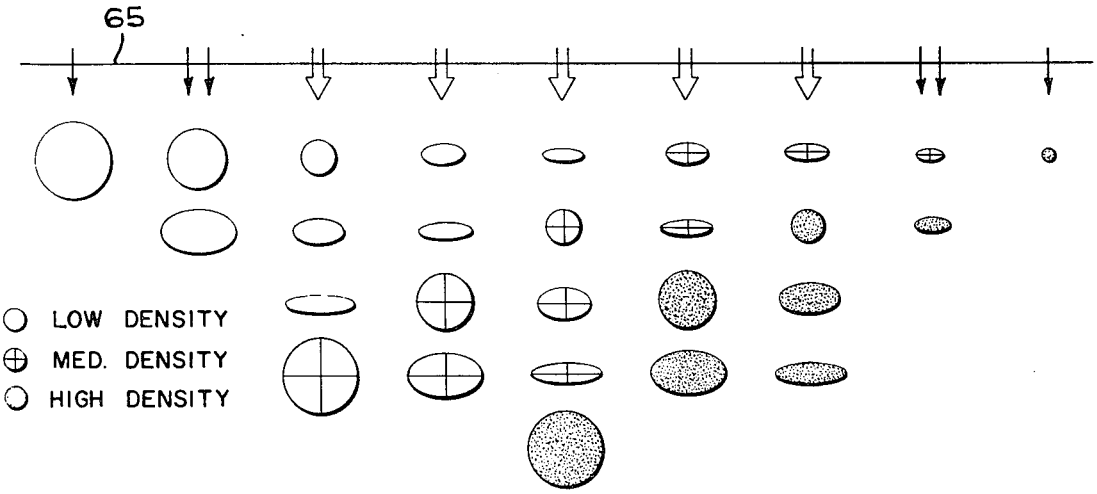
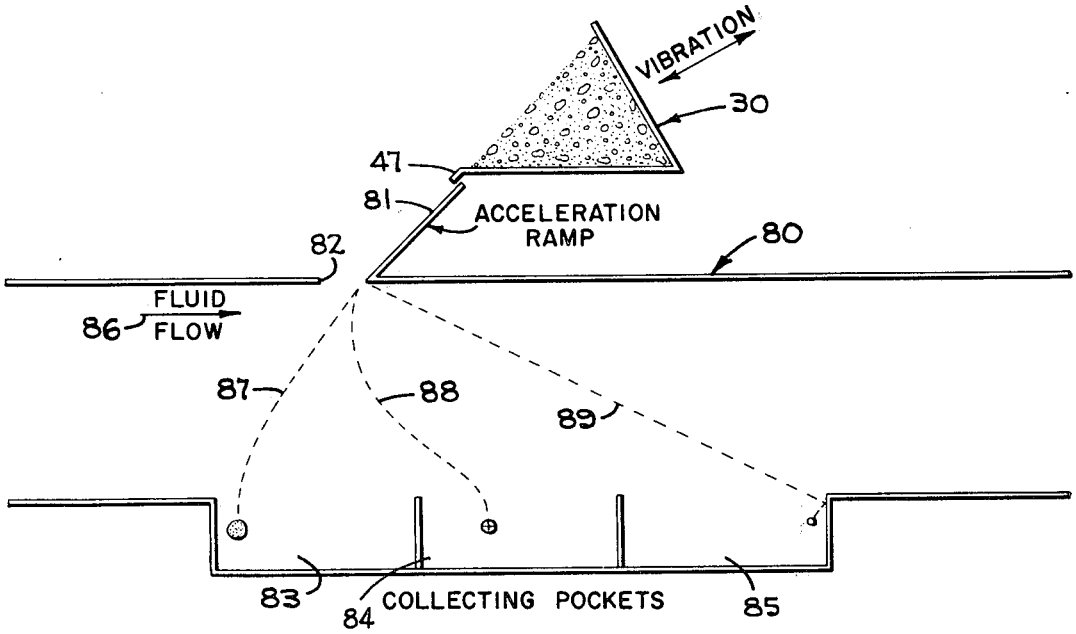
FIG_15

FIG_16
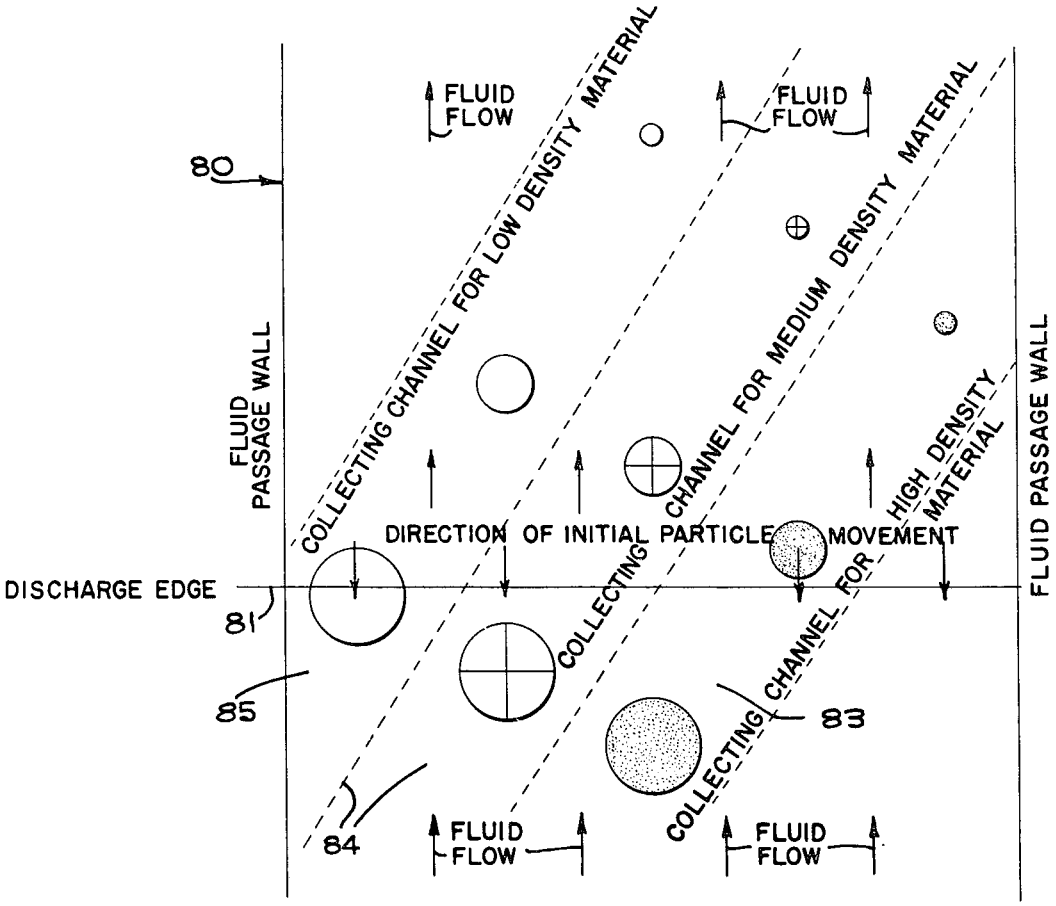
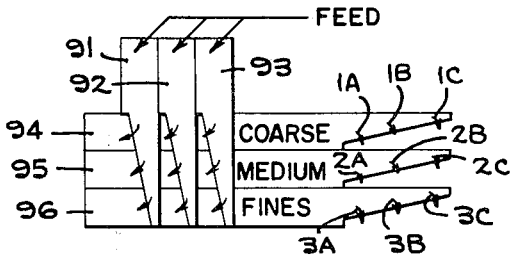
1A- SUPER COARSE
1B- COARSE ONLY
1C- COARSE MEDIUMS
2A-COARSE MEDIUMS
2B-MEDIUMS ONLY
2C-MEDIUMS & FINES
3A-MEDIUMS & FINES
3B-FINES ONLY
3C-SUPER FINES
FIG_17

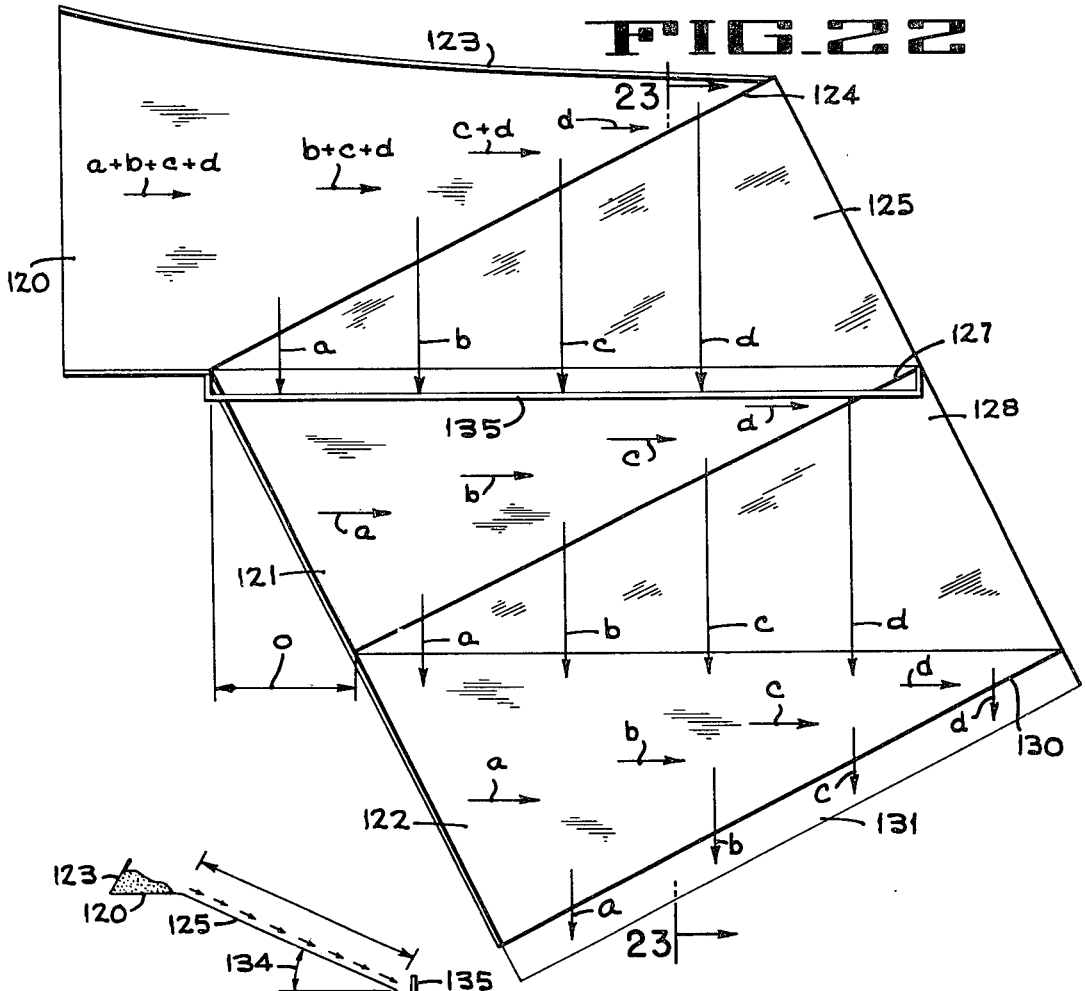
FIG_22
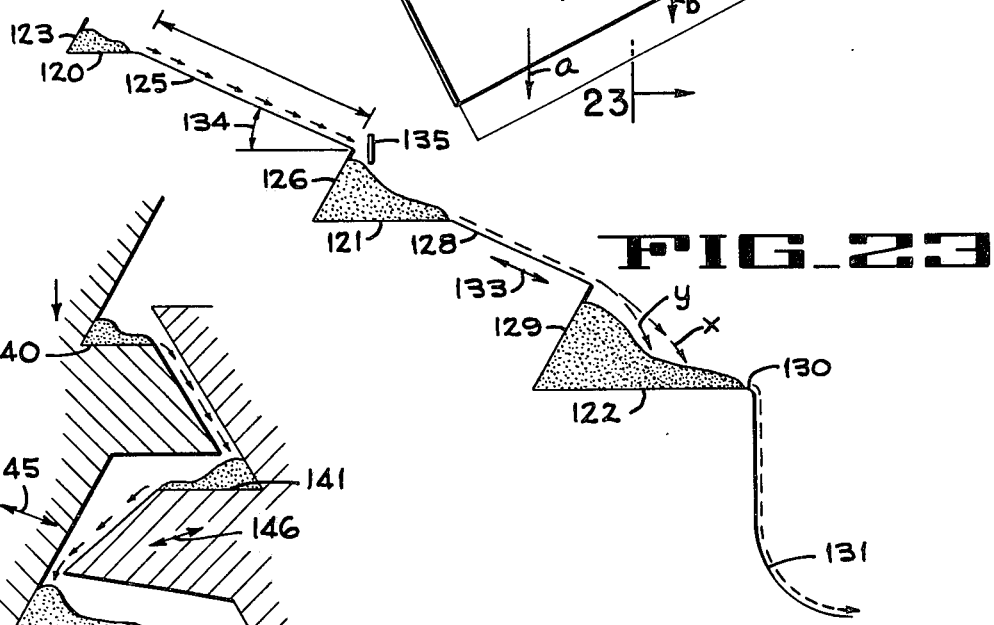
FIG_23
FIG_24

METHOD OF AND APPARATUS FOR ASSORTING PARTICLES ACCORDING TO THE PHYSICAL CHARACTERISTICS THEREOF

CROSS-REFERENCE TO RELATED APPLICATION

The present application is a division of application Ser. No. 330,896, filed Feb. 9, 1973, now Pat. No. 3,904,517.

BACKGROUND OF THE INVENTION

1. Field of the Invention

This invention relates to a method of and apparatus for classifying, separating and assorting particles. More particularly, the invention involves combinations of separations to segregate particles having like physical characteristics from a mixture of particles having various physical characteristics.

2. Description of the Prior Art

Shaking tables have been used for segregating particles according to physical characteristics by simultaneous separating actions that include standard and reverse classification by size and stratification according to specific gravity. Examples of such shaking tables are shown in U.S. Pat. Nos. 1,044,067; 1,315,880 and 1,999,000. While such shaking tables provide a rough, crude or limited separation, it has been necessary to sift certain material through screens after such segregation by the shaking tables to achieve a finish degree of separation. Screening is difficult to perform continuously because retained particles block the screen and necessitate frequent interruptions in the separation operation. Separation by screening is most effective when there is but a small quantity of material having a size approximately the same as any one sieve size although the material screened can vary over a wide range of sizes. Shaking tables operate more effectively when all of the particles are nearly the same size, and the size range of material that can be treated is therefore smaller for shaking tables than for screens.

A finish or fine degree of separation is also difficult to achieve with shaking tables because particles of different classification are often re-mixed upon removal from a stratified bed. Normally, the planes of stratification are substantially horizontal and the order of classification is along a vertical axis. The uppermost particle stratum must be skimmed or scalped from the lower particle strata, and, unless the plane of removal coincides with the plan of strata separation, particles from more than one stratum will be mixed. For continuous operation, removal is usually achieved by gravitational flow down a plane inclined relative to the horizontal or by vibratory feeding of the material along an inclined plane; in using this procedure different classes of particles are mixed to some extent because they are removed from more than one stratum at a time.

SUMMARY OF THE INVENTION

Solid particles which vary in such physical characteristics as size, density or shape can be sorted according to one or more of the physical characteristics thereof by feeding a mixture of such particles upon a support surface, directing the particles thereon to flow in a stream having a transverse section with an unconfined side that slopes upward from the support surface to a height representing a multiplicity of layers, and causing particles within the stream to have a spiral transverse flow to follow generally helical paths which diminish in spiral radius with longitudinal advancement in the direction of stream flow. The motion of the particles thereby segregates the particles according to physical characteristics in an order of classification extending transversely of the stream so that particles having similar physical characteristics flow in the same portion of a transverse section of the stream. The particles flowing from a plurality of portions of the stream transverse section can then be separately collected. Such a method can be practiced by apparatus that includes a surface for supporting a stream of particles, a wall connected to one longitudinal side of said surface and projecting upwardly therefrom to support one side of said particle stream, a feeder for continuously supplying particles to said stream, a vibrator for vibrating said surface to impart successive impulses to drive the particles toward the side wall, an acceleration ramp to accelerate the velocity of the particles in the horizontal direction, and a plurality of collectors for separately collecting particles at locations spaced transversely of said stream. Fluid means may also be used, if desired, to further separate the particles in a direction extending transversely from the edge of the stream support surface over which the particles gravitate.

BRIEF DESCRIPTION OF THE DRAWINGS

FIG. 5 is a diagrammatic transverse section of a stream of particles illustrating various classification principles.

FIG. 6 is a diagrammatic transverse stream section illustrating the circulation of particles therein in the practice of the present invention.

FIG. 7 is a diagrammatic view illustrating the helical path of particle travel diminishing in radius progressively with advancement along a longitudinal axis.

FIG. 8 is a diagrammatic view illustrating an order of particle classification extending transversely of the stream section as achieved in the practice of the present invention wherein particles of similar characteristic classification are grouped together in stream portions which extend upward from the support surface.

FIG. 9 is a diagrammatic illustration of an arrangement of multiple separators interconnected for recycling material to achieve a finish degree of separation.

FIG. 14 is a diagrammatic illustration of the order of classification at the discharge lip when particles vary in size, shape and density.

FIG. 15 is a diagrammatic view illustrating a modification of the apparatus of the present invention wherein particles fall from an acceleration ramp through a fluid passage to collecting receptacles.

FIG. 16 is a diagrammatic plan view illustrating the separation of particles within the apparatus shown in FIG. 15.

FIG. 17 is a diagrammatic illustration of a multiple separator arrangement constructed in accordance with the principles of the present invention to achieve a wide range of particle separations.

FIG. 22 is a diagrammatic plan view of three separators arranged in a staggered relationship for separating material to a finish degree of separation.

FIG. 23 is a section in elevation taken on the line 23—23 of FIG. 22.

FIG. 24 is a section in elevation of a modified multiple separator arrangement having four stages.

DESCRIPTION OF THE PREFERRED EMBODIMENTS

Figures 1, 2, 3, 4:
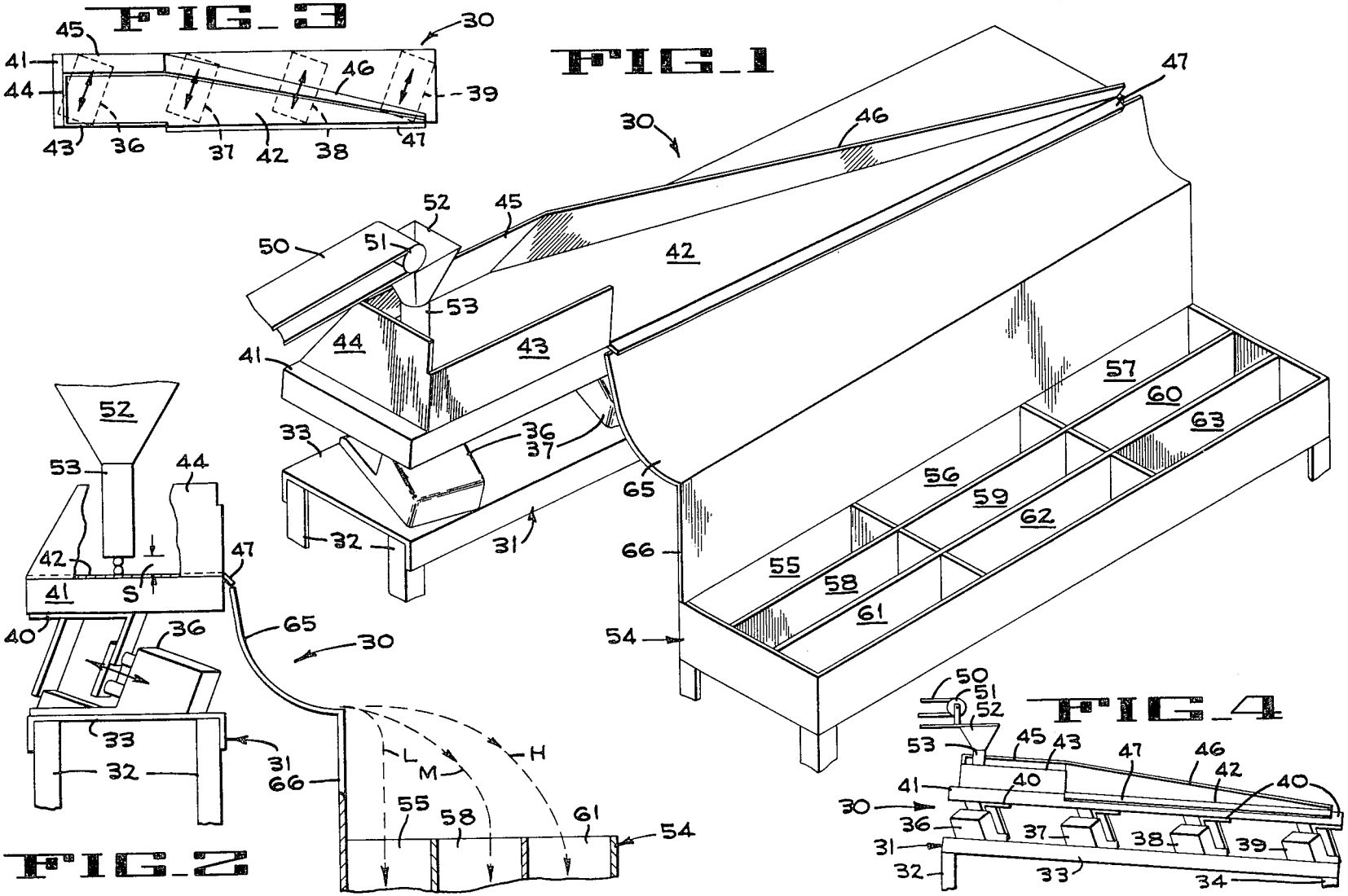
FIG. 1 is a perspective view of a particle separator embodying the present invention and for practicing the same.
FIG. 2 is a broken end view of the particle separator shown in FIG. 1.
FIG. 3 is a reduced plan view of the separator shown in FIG. 1 illustrating, in phantom lines, the arrangement of vibrators thereunder.
FIG. 4 is a reduced side elevation view of the separator shown in FIG. 1 with the collecting receptacle removed to illustrate the vibrators and the downward longitudinal slope of the separating surface.

With reference to FIGS. 1, 3 and 4, particle separator 30 has a bench 31 that includes a pair of legs 32 supporting one end of a seat 33 and another pair of legs 34 supporting the opposite end of the seat. Legs 34 are shorter than legs 32 so that the seat is downwardly inclined, as shown in FIG. 4. Vibrators 36, 37, 38 and 39, which may be of the conventional electromagnetic type, are mounted at spaced intervals along the bench and, preferably, are skewed downward with respect to a transverse bench section (as illustrated in FIG. 3). Skewing of the vibrators provides a force component upon material handled by particle separator 30 in the same direction as the downwardly inclined slope of the seat. While both gravitational and vibratory force components in the longitudinal direction of movement are not required on one separator, they may be combined to provide a desired flow force. A suitable vibrator for use in practicing the present invention is the "Vibra-Drive" unit model F-010 manufactured by the Syntron Division of FMC Corporation, Homer City, Pa. Such a vibrator provides oscillation at the applied electrical frequency (60 cps) to a horizontally located mounting bracket 40 wherein the impulses are provided at an angle of approximately 20° with the plane of the mounting bracket.

A plank 41 of light weight and large cross-section modulus to prevent unwanted vibrations is attached to the flat-surfaced load mounting brackets 40 (FIG. 2) of each of the vibrators 36, 37, 38 and 39 and serves to support a generally channel-shaped structure which carries the material to be separated. This channel structure includes a support surface 42 bounded at one end by an upright side wall 43 that is attached to an end wall 44 which is, in turn, connected to an inclined side wall 45. A second inclined side wall 46 extends diagonally from side wall 45 to the opposite end of the support surface, and a short discharge lip 47 extends between side walls 43 and 46 to define the unbounded side of the support surface. The discharge lip slopes downward from surface 42 at an angle from the horizontal of approximately 20°, which is approximately the same as the angle of vibration, so that particles moving upon the lip will not be unduly affected by the applied vibratory impulses.

Particles are fed to surface 42 by an endless conveyor belt 50 that is trained about an idler roller 51 mounted above a hopper 52 having a chute 53 that discharges onto the surface. The chute is spaced above the surface by a distance S, shown in FIG. 2, equal to at least twice the diameter of the largest particles to be separated to prevent plugging of the chute.

A collecting receptacle 54 is positioned below and outward from discharge lip 47 to receive particles discharged. The receptacle is divided into compartments 55, 56 and 57 arranged in a row parallel with the discharge lip; compartments 58, 59 and 60 form a middle row spaced outward from compartments 55, 56 and 57; and compartments 61, 62 and 63 form an outermost row of compartments. The receptacle compartments can be provided with bottoms which may be opened when desired to remove the assorted particles collected therein.

An acceleration ramp 65, which is entirely detached from the vibrated structure of the separator 30, is provided beneath discharge lip 47 so that particles falling from the lip will roll or slide down the ramp and develop their maximum terminal velocity due too gravity before being discharged therefrom with the curved surface of the ramp converting the vertical terminal velocity into a horizontal velocity component at an elevation spaced above the compartments of collecting receptacle 54. The acceleration ramp is spaced just under the discharge lip which vibrates with surface 42, and the ramp can be supported by an upwardly extending back wall 66 of the collecting receptacle.

In operation, particles to be assorted are continuously supplied to separator 30 by conveyor belt 50 and hopper 52. The particles fall onto the support surface 42 in the channel portion enclosed by side wall 43, end wall 44 and side wall 45. There the particles are subjected to vibratory impulses upward and toward side wall 45 while the material, in general, tends to flow by gravity down the inclined support surface 42.

The vibratory impulses, represented by the double headed arrows in FIGS. 2 and 3, are provided in a direction which is inclined upwardly at an angle of approximately 20° with the horizontal (FIG. 2) and skewed downwardly from a transverse section of the surface at an angle of approximately 20° also (FIG. 3). The amplitude of the vibratory strokes can be varied proportionally from the largest at vibrator 36 at the delivery end of the separator to the smallest at vibrator 39 at the discharge end of the separator so that the impulses gradually diminish as the material is propelled down the surface 42. However, depending upon the particle size and stroke frequency, it is sometimes more desirable for each vibrator to have the same amplitude of vibratory stroke.

Side walls 45 and 46 project upwardly from the side edge of surface 42 to deflect particles, driven towards the side walls by the vibratory impulses, backward and upward therefrom. The particles thereby tend to form a pile adjacent the side walls having a height representing a multiplicity of particle layers and an unconfined side that slopes between the top of the pile and the underlying support surface 42. The approximate optimum inclination of the walls 45 and 46 is 60° with the horizontal. Any angle of inclination larger than this will tend to cause the peak of the pile of particles to form too far forward of the wall and some of the large particles will be trapped between the wall and the peak of the pile. Particles deflected backward from the side walls will either percolate downwardly through the pile towards the support surface or roll down the unconfined side of the pile. Thus, there is continuous transverse circulation of material within the pile of particles, which pile also flows longitudinally, parallel with the side walls, as a stream due to gravity acting upon the inclined slope of the support surface 42 and the force component supplied by the skewed vibrators.

Since the location of the bottom of chute 53 determines the amount of material which will be on the separator at any given time (assuming the hopper 52 is kept full of material), the flow rate can be controlled by shifting the location of the hopper and chute. It is preferred to control the flow of material by shifting the hopper and chute along a line parallel to the end wall 44 with the bottom of chute 53 remaining at a fixed spacing from the support surface 42. As the hopper is moved closer to the side wall 45, the location of the toe of the slope of the material pile will also move closer thereto. As the hopper is moved closer to the side wall 43, the toe of the slope will move away from side wall 45 thus increasing the size of the pile of material on the separator, i.e., increasing the flow rate. The slope of the material pile, which is determined by the lateral forces imposed by the vibrators 36–39, will remain constant. In practice, it is normally desirable to adjust the flow rate such that the initial separation will occur at the adjacent edges of side wall 43 and discharge lip 47.

Particles circulated in the manner described tend to be classified in accordance with the recognized principles of self-screening and stratification. The term "self-screening" as used herein means that smaller particles percolate through the voids between larger particles while particles larger than such voids are retained. Thus the particles once set in motion tend to screen themselves into an order of classification without direct physical intervention. Looking now at FIG. 5, which represents a vertical section within a pile, fine (i.e., small) particles tend to percolate towards support surface 42 while larger particles are retained or "floated" upward by the fine particles. This movement, considered by itself, will result in a reverse order of classification as indicated by the stack of particles 70. On the unconfined side slope, particles tend to roll down the slope until retained in a notch between particles. Thus, the largest particles roll to the toe of the slope, while the fine particles travel but a short distance before percolating downward through the slope. This movement, considered by itself, will result in a regular order of classification, with the coarse particles on the bottom and the fine particles on the top, as indicated by the line of particles 71.

Due to the vibratory impulses toward side wall 46, fine particles tend to sift between larger particles and move towards the side wall, while the larger particles are retained or repelled backward by the build-up of fine particles. This movement, considered by itself, will result in an order of classification transversely of the pile from the large particles adjacent the unconfined slope to the fine particles adjacent the side wall, as represented by the line of particles 72 in FIG. 5.

A further principle of classification takes place within the pile. Assuming that all particles have the same size and shape but vary in density, in a vertical plane the heavy particles will sink by gravity towards the bottom while the light particles will float upon the heavy particles to provide an order of classification as represented by the line of particles 73 in FIG. 5. A somewhat similar classification occurs transversely of the pile due to the vibratory impulses which cause the heavy particles to move towards the side wall while the lighter particles are retained or repelled outward towards the unconfined side, as represented by the line of particles 74 in FIG. 5.

When the aforedescribed apparatus is operated particles within the pile tend to circulate transversely as indicated by the arrows in FIG. 6. Fine particles following paths represented by dashed lines tend to congregate adjacent side wall 46, while coarse particles following paths represented by solid lines accumulate adjacent the toe of the unconfined side of the pile. Simultaneously, the particles are flowing longitudinally down the slope of surface 42 so as to follow generally helical paths that diminish in diameter in the direction of flow, as indicated in FIG. 7. The result of all of the aforedescribed material movements is that particles are classified in an order of classification according to physical characteristics (size or density) extending transversely of the stream cross section, as indicated in FIG. 8, with particles having similar physical characteristics grouped in the same portion of the stream section.

The support surface 42 tapers to a point where the inclined side wall 46 contacts the discharge lip 47 at the end of the separator. Thus, as the stream section is reduced, particles having similar physical characteristics (i.e., similar size and density) will be discharged along a given portion of the discharge lip and can be separately collected in receptacle compartments thereunder. Particles varying in but one physical characteristic, such as size, will be separated sufficiently at this point.

When particles vary in more than one physical characteristic, such as size and density, further assortment is necessary. This can be accomplished by utilizing the gravitational forces which accelerate the particles rolling down the acceleration ramp 65 to a terminal velocity having a horizontal component. Small light particles develop their maximum velocity quickly while rolling down the acceleration ramp and have low terminal velocity whereby they fall adjacent to the ramp, as indicated by line L in FIG. 2. Medium sized and denser particles develop a somewhat larger terminal velocity to follow line M, while large heavy particles develop a greater terminal velocity and follow line H. The length of the acceleration ramp 65 should be such that the largest and heaviest particles will develop their maximum velocity (as limited by the frictional forces imposed by the ramp) while they roll upon the acceleration ramp; thus, all particles will reach their respective maximum velocities so that they can be separated in accordance with their ejection distance from the ramp. The horizontal velocity attained by the particles moving down the ramp 65 is dissipated by the drag caused by air resistance. The small horizontal velocity of the small particle is lost very quickly and therefore gives the appearance of dropping straight down (the velocity in the vertical direction is maintained by the force of gravity). The large horizontal velocity of the large particles is slow to respond to the air resistance and therefore travels a much greater horizontal distance before its trajectory of fall is only in the vertical direction.

Figure 10:
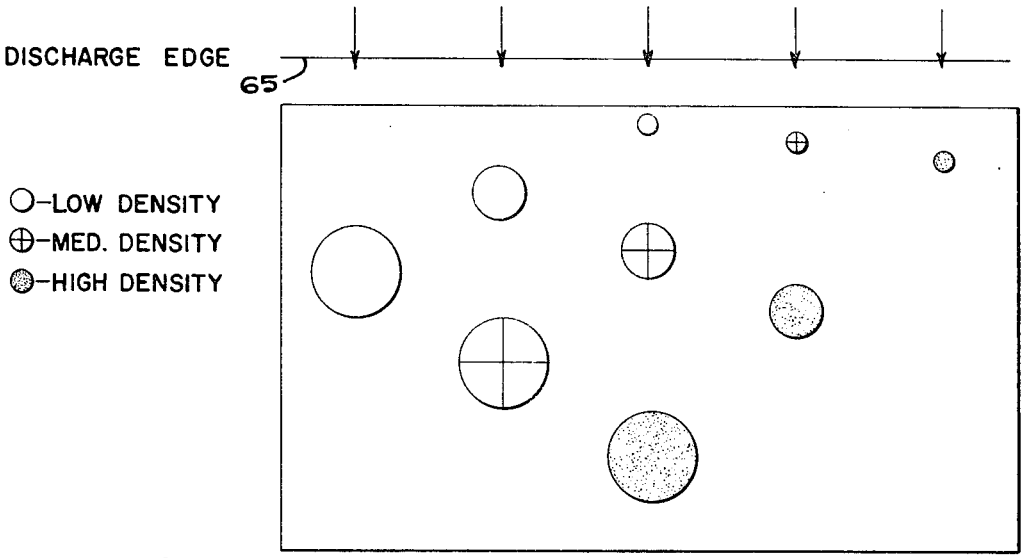
FIG. 10 is a diagrammatic illustration of an assortment of particles that vary in both size and density as discharged from a separator of the present invention having an acceleration ramp, said Figure showing the differences in their trajectory of fall after rolling down the acceleration ramp which provides a basis for secondary separation.

Particles of the same size but varying in density between light, medium and heavy will approach discharge lip 47 at separate locations in accordance with their position in the pile and will, therefore, be discharged at different locations along the discharge lip. Particles of like density but varying in size between large, medium and small will also be discharged at different locations and thereby separated. These orders of classification achieved by the varying discharge locations tend to overlap when particle differences are defined by two or more characteristics so that, for example, particles of different size and density may be discharged at the same location along the discharge lip. However, such particles will be accelerated to a terminal velocity proportional to the size and density thereof as they roll down the acceleration ramp and, upon falling therefrom, will be assorted as indicated in FIG. 10. Thus, a large dense particle, a medium-sized medium-dense particle, and a small light particle may all be discharged at the same location from the ramp 65, but they will each achieve different terminal velocities upon the ramp so that they can be collected in different compartments in the collection receptacle. For example, with reference to the receptacle of FIG. 1, the large dense particle may be received in the outer compartment 62 with the medium-sized medium-dense particle received in compartment 59 and the small light particle received in compartment 56.

Figure 11:
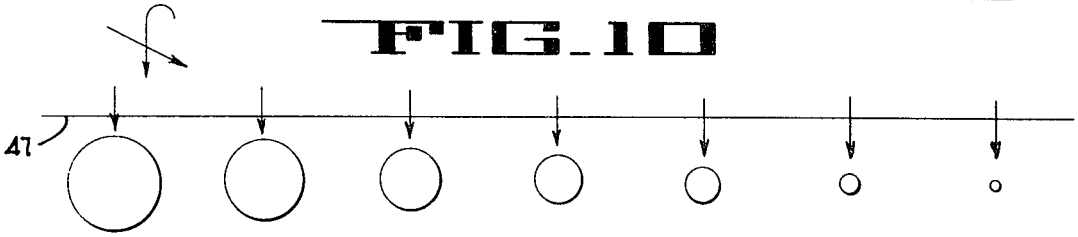
FIG. 11 is a diagrammatic illustration of the order of classification at the discharge lip of a shaker table when particles vary only in size.
Figure 12:
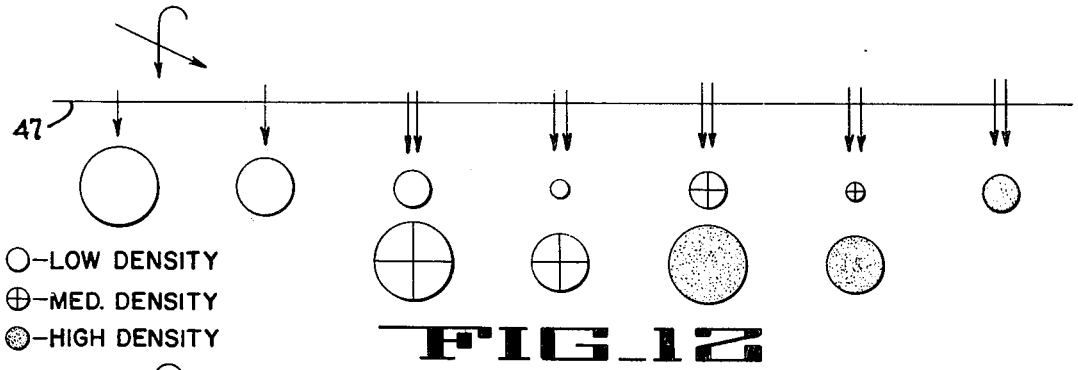
FIG. 12 is a diagrammatic illustration of the order of classification at the discharge lip when particles vary in both size and density.
Figure 13:
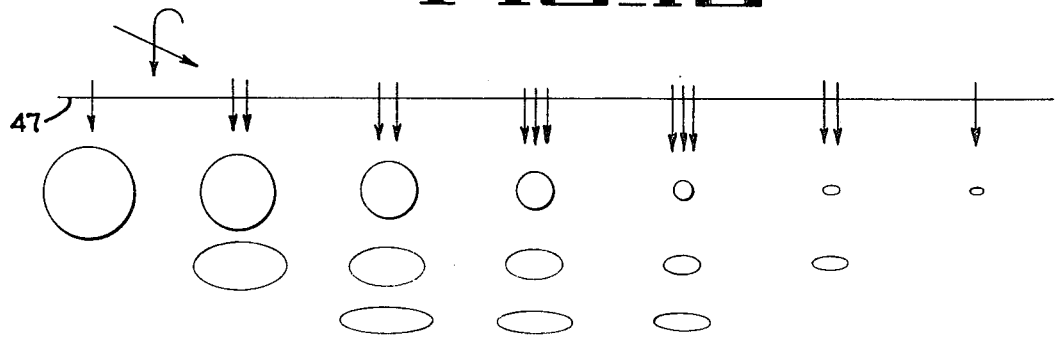
FIG. 13 is a diagrammatic illustration of the order of classification at the discharge lip when particles vary in both size and shape.

When particles fed to separator 30 have the same density and relative shape but vary in size only, discharge over lip 47 will be in an order of classification, as illustrated in FIG. 11. The largest particle is discharged first, while the smallest particle is discharged last and intermediately sized particles are discharged in a uniform order of classification therebetween. When particles varying in density are combined with particles varying in size, distribution along the discharge lip is in the order illustrated in FIG. 12 with an overlapping of particles having different sizes and densities. Similarly, when particles of the same density but varying in size and shape are combined, there is an overlapping distribution of particles along the discharge lip, as illustrated in FIG. 13, wherein the rounder, more spherical particles will be discharged before other particles having the same maximum diameter but being more oblate in shape. As pointed out, particles varying only in size and density can be separated by their trajectory of fall after initial separation by the separator, and, in like manner, particles varying only in size and relative shape can also be separated by their trajectory of fall once they are roughly separated by the separator 30 as shown in FIG. 13.

Particles which vary in size, relative shape and density can be separated into overlapping orders of classification, as illustrated in FIG. 14. Then the particles can be further assorted according to density by their trajectory of fall since it will be recognized that for any given group of particles discharged from the acceleration ramp at a common location, the densest particles will be ejected the greatest distance. Usually, for separating particles such as ore into individual minerals this two-stage separation process will be sufficient since particles of the same density will be grouped together in diagonal zones of the collecting receptacle and particle shape is not of concern. However, the particles accumulated in each compartment of the collecting receptacle can be screened through an assortment of sieve sizes to provide further separation based on the characteristics of size and shape of the particles.

Looking now at FIG. 15, a modified form of the invention is there shown. A fluid passage 80, such as a wind tunnel, is positioned beneath the discharge lip 47 of the separator 30, and an acceleration ramp 81 extends from the fluid passage to a point directly adjacent to the discharge lip at approximately the same slope as the discharge lip. An opening 82 is provided in the fluid passage adjacent the acceleration ramp to provide a means to enable the particles to be ejected into the fluid passage. Collecting compartments 83, 84 and 85 are positioned along the bottom of the fluid passage to receive particles falling therein. Fluid flow direction is indicated by arrow 86.

Particles of large size and high density will be least affected by the fluid flow and will follow the particle path represented by the dashed line 87 into compartment 83. Particles of medium size and density follow the path represented by dashed line 88 into compartment 84, while small, low density particles will be carried by the fluid flow along dashed line 89 into compartment 85. This arrangement provides a greater degree of particle separation.

Collecting compartments 83, 84 and 85 are of channel shape and aligned at an oblique angle with discharge lip 47 as illustrated in FIG. 16, so particles of similar density, regardless of size, will be collected in the same compartment. Acceleration ramp 81 could be eliminated by placing discharge lip 47 adjacent opening 82 but this would reduce the differential velocity between various types of particles entering the fluid passage and the resulting degree of particle separation.

Multiple particle separator units can be grouped together in tiers, as illustrated in FIG. 17, to achieve a greater degree of particle separation. Separators 91, 92 and 93 are fed an aggregate of particles which they separate into coarse, medium and fine size gradations. These separated particles drop respectively onto a lower tier of separators 94, 95 and 96 which further separate each of the coarse, medium and fine segregations into large, intermediate and small fractions. By recycling the overlapping size fractions (i.e., 1C, 2A, 2C and 3A in FIG. 17) a greater overall degree of separation can be achieved.

Figure 18:
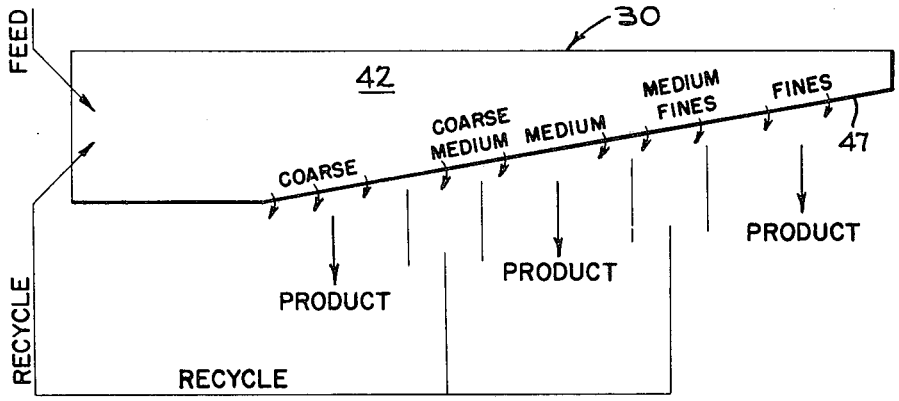
FIG. 18 is a diagrammatic view illustrating another modification of the apparatus of the present invention that provides for recycling a portion of the assorted particles.

Another modification of the invention is illustrated in FIG. 18. A particle separator 30 as previously described is used for separating particles but portions of the separated particles which are intermediate of the primary size classifications (identified in FIG. 18 as coarse, medium and fine), i.e., borderline particles, are recycled through the separator to obtain more highly refined separations.

Figure 19:
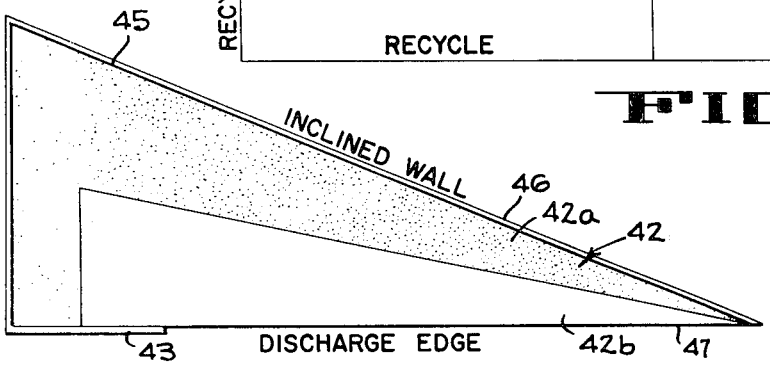
FIG. 19 is a plan view of yet another modified form of the apparatus of the present invention wherein the particle support member includes a portion with a smooth surface and another portion with a rough surface.
Figure 20:
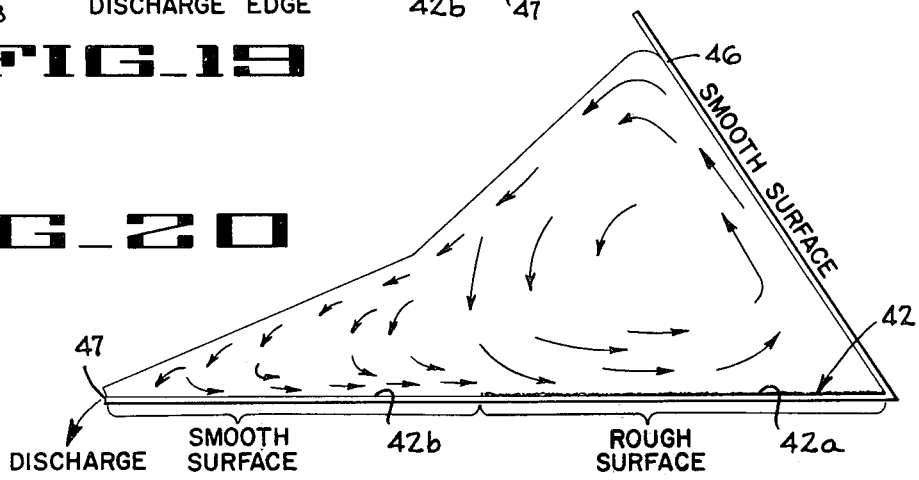
FIG. 20 is an enlarged diagrammatic transverse section of the separator apparatus shown in FIG. 19 illustrating the particle circulation therein.

A further modification of the invention is illustrated in FIGS. 19 and 20. Support surface 42 is divided into a rough surface section 42*a* adjacent the feed end of the separator (i.e., between side walls 43 and 45) and along inclined side wall 46 and a smooth surface section 42*b* adjacent discharge lip 47. Particles circulate more rapidly over a rough surface where the direction of vibration is generally in the direction of the plane of the surface due to the increased friction provided by the rough surface. By increasing the circulation rate of particles, more self-screening or stratification action takes place along a given length of surface to provide a more highly refined classification. The smooth surface slows down the transverse oscillation of particles so that the order of classification can be maintained adjacent the discharge lip where particles are removed from the support surface by transverse slippage. The inclined wall 46 of the vibrator is also provided with a smooth surface so that the wall surface will promote rather than retard the circulation of material. A suitable rough surface can be obtained by fastening silicon carbide paper No. 400 to section 42*a*, and a suitable smooth surface can be obtained by fastening a polyester tape to section 42*b* and the inclined surface of wall 46.

Figure 21:
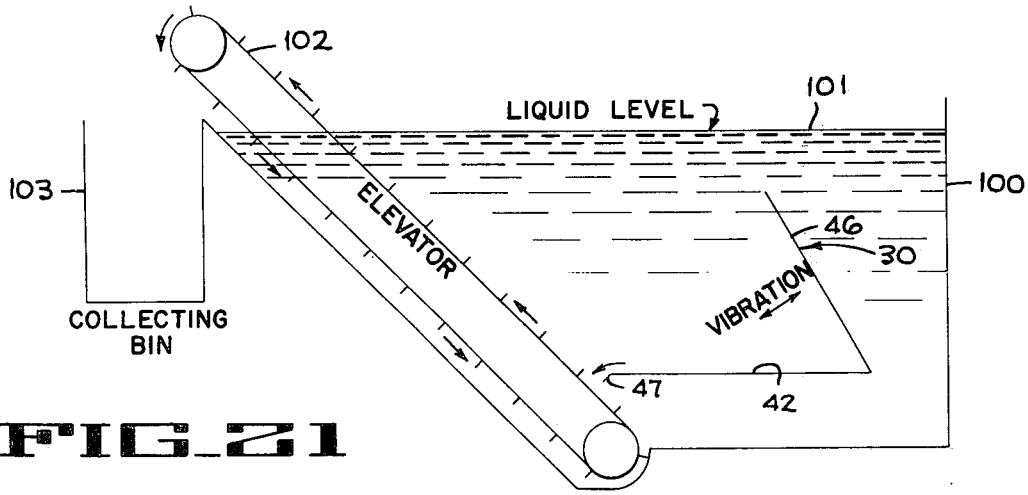
FIG. 21 is a diagrammatic view of a still further modified form of the invention wherein the separator is submerged within a liquid while performing the particle separation process.

A further modification of the invention is illustrated in FIG. 21. A particle separator 30, as previously described, is submerged in a tank 100 beneath a liquid level 101. An elevator 102 of the endless belt type having pockets thereon with a horizontal width at least equal to the horizontal length of discharge lip 47 is positioned to receive particles from the discharge lip in the same relative positions as discharged and deposit the particles in the same order in a collecting receptacle 103, located out of the liquid. The liquid facilitates the separation of particles that vary in density because the separation factor, i.e., the ability of the separator to differentiate two different densities, is inversely proportional to the difference between the density of the lightest particle to be separated and the density of the medium in which the separation takes place. For example, where the material to be separated is made up of two components with densities of 2.0 and 3.0, the separator would normally (in air) have a separation factor of $$\frac{3.0-2.0}{2.0} = 0.5.$$

The wet separator of FIG. 21 (if the liquid were water, density = 1.0) would have a factor $$\frac{3.0-2.0}{2.0-1.0} = 1.0,$$

an increase of the separation factor by 100%.

Additional modifications of the invention are illustrated in FIGS. 9, 22, 23 and 24. These modifications include arrangements of multiple separators interconnected for recycling material to achieve a finish or fine degree of separation.

Voids occur between particles flowing in a pile on a separator, and the movement of an adjacent particle into the void is determined by the magnitude of force acting upon each adjacent particle in the direction of the void. Particles varying greatly in physical characteristics are therefore more rapidly separated than particles having nearly the same physical characteristics. Thus, to achieve a finish or fine degree of separation on particles having nearly the same physical characteristics, it may be necessary to divide up the separated material after a preliminary separation and repeat the separation process one or more times.

With reference to FIG. 9, material to be separated is fed to a preliminary separator 110 and the discharge therefrom is separated into three parts, which in turn are fed to three secondary separators 111, 112 and 113. The secondary separators can be of a smaller size than the preliminary separator because they handle less material. The discharge from each secondary separator is further divided into three parts, with one being discharged and the other two being recycled. When the discharge from preliminary separator 110 is separated so that large material is fed to secondary separator 111, medium material is fed to secondary separator 112, and small material is fed to secondary separator 113, only the material size corresponding closest to that handled by the respective secondary separator is discharged therefrom, while more remote sizes are recycled to the other two separators. In this manner, more accurate sizing is achieved.

Looking now at FIGS. 22 and 23, an alternative multiple separator arrangement is shown which includes a preliminary separator 120, an intermediate separator 121 and a finish separator 122. The preliminary separator 120 has a back wall 123 and a discharge lip 124. An inclined ramp 125 connects discharge lip 124 with a back wall 126 of separator 121. Similarly, an inclined ramp 128 connects a discharge lip 127 of separator 121 with a back wall 129 of separator 122. The separator 122 has a discharge lip 130 which has an acceleration ramp 131 attached thereto.

It will be noted that material is fed between separators 120, 121 and 122 while maintaining the material in its separated (or partially separated) state from the discharge edge of one separator to the back wall of the next separator. The discharge edges of the separators are progressively offset by a distance O (FIG. 22). Intermediate separator 121 and finish separator 122 have a normal separator configuration (as described previously), but preliminary separator 120 must have a different configuration to compensate for the fact that material feed to separator 120 is received only at one spot as represented by arrow $a+b+c+d$ while separators 121 and 122 receive material along the length of their back walls. As the material progresses longitudinally over separator 120, portions of the material are discharged over discharge lip 124 as represented by individual arrows *a*, *b*, *c* and *d*. Thus, it will be seen that separator 120 must have a progressively wider cross section than the separators 121 or 122 in order to accommodate the progressively larger quantity of flow on the upstream end of the separator.

Separators 120, 121 and 122 are vibrated in a direction as indicated by arrow 133 in FIG. 23. Ramps 125 and 128 are inclined to the horizontal by an angle 134 which is the same as the vibration angle. A stop 135 is spaced outward from the lowermost end of ramp 125 and extends the length of back wall 126 to force material which has rolled or slid down the ramp to fall upon the top of the pile of material on separator 121 and thereby be fully processed (i.e., recirculated) by that separator. Such a stop is important when density separations are being made. When only sizing separations are performed, it may be advantageous to omit the stop, as indicated on the lower separator 122, to allow large particles to follow path *x* (FIG. 23) and fall near the toe of the pile where discharge from the pile will be made easier while smaller particles follow path *y* and fall closer to the top of the pile where their containment within the pile will be made easier.

A modified form of the invention illustrated in FIG. 24 provides for separation in four stages. A pair of separators 140 and 142 are vibrated in a direction as indicated by an arrow 145, while a complementary pair of separators 141 and 143 are vibrated in a direction as indicated by an arrow 146. Material being separated flows downwardly onto separator 140, then progressively to separators 141, 142 and 143. The four stage separating action is somewhat more refined than that obtained by the three stage separators shown in FIGS. 22 and 23, and the complementary arrangement of the separators minimizes spatial requirements.

From the foregoing description it will be apparent that a mixture of particles which vary in one or more physical characteristics can be effectively assorted into groups of particles having similar characteristics. When particles vary only in size, they are separated at locations along discharge lip 47 corresponding to their relative particle size. Should the particles vary in another physical characteristic, such as density, a further separation of particles can be made after leaving the discharge lip based upon their trajectory of fall to a plurality of compartments in a collecting receptacle. The apparatus is inexpensive to manufacture, simple to operate, and adaptable for continuous operation.

Although the best modes contemplated for carrying out the present invention have been herein shown and described, it will be apparent that modification and variation may be made without departing from what is regarded to be the subject matter of the invention.

What is claimed is:

1. An apparatus for continuously assorting particles by the physical characteristics thereof, said apparatus comprising a surface for supporting a stream of particles; a wall connected to one side of said surface and projecting upwardly therefrom to support one side of the particle stream; means for vibrating said surface to impart impulses to the particles thereon for driving said particles toward the wall; said surface having a width that decreases proportionally with the length of the wall to gradually reduce the transverse section of the particle stream; a plurality of collecting compartments aligned transversely of the particle stream and in alignment with the edge of said surface opposite from that defined by said wall whereby said compartments receive particles from the surface in an order of classification with particles having similar physical characteristics being collected in the same compartment; an acceleration ramp positioned below said surface on the opposite side thereof from said wall, said ramp being downwardly inclined from said surface for a distance sufficient to enable particles gravitating down the ramp to accelerate to their maximum terminal velocity in a direction having a desired horizontal component; and said plurality of collecting compartments aligned transversely of the particle stream further including a plurality of collecting compartments aligned in the direction of particle flow from the acceleration ramp whereby particles are further separated in accordance with their size and density by their trajectories of fall from the acceleration ramp to the collecting compartments.

2. The apparatus described in claim 1 which further includes means providing a fluid passage beneath said acceleration ramp to receive particles discharged from said ramp with said plurality of collecting compartments being located at the bottom of the fluid passage, said fluid passage extending transversely to said acceleration ramp, and means for providing a fluid current in said fluid passage whereby said particles are further separated in accordance with their size and density by their trajectories of fall from the acceleration ramp through said fluid current to the collecting receptacles.

3. The apparatus described in claim 1 which further includes means providing a fluid passage beneath said surface and extending transversely to said acceleration ramp to receive particles discharged from said acceleration ramp; means for providing a fluid current in said fluid passage opposed to the horizontal component of particle velocity developed by the gravitation of the particles down the acceleration ramp.

* * * * *